US011128090B2

(12) United States Patent
Mamiya et al.

(10) Patent No.: US 11,128,090 B2
(45) Date of Patent: Sep. 21, 2021

(54) CONNECTOR WITH LOCK ARM HAVING A FORWARDLY OPEN ENTRANCE SPACE THAT RECEIVES TIP OF MATING CONNECTOR TO SHORTEN FRONT-REAR DIMENSION AFTER CONNECTION

(71) Applicant: Sumitomo Wiring Systems, Ltd., Yokkaichi (JP)

(72) Inventors: Yuma Mamiya, Yokkaichi (JP); Shinjiro Kida, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/911,647

(22) Filed: Jun. 25, 2020

(65) Prior Publication Data

US 2020/0412050 A1 Dec. 31, 2020

(30) Foreign Application Priority Data

Jun. 27, 2019 (JP) ..... JP2019-119714

(51) Int. Cl.
*H01R 13/641* (2006.01)
*H01R 13/627* (2006.01)
*H01R 13/52* (2006.01)

(52) U.S. Cl.
CPC ..... *H01R 13/6272* (2013.01); *H01R 13/641* (2013.01); *H01R 13/5219* (2013.01)

(58) Field of Classification Search
CPC ..... H01R 13/641; H01R 13/6272
See application file for complete search history.

(56) References Cited

U.S. PATENT DOCUMENTS 4,708,413 A * 11/1987 Schroeder ..... H01R 13/6272 439/352
6,024,595 A * 2/2000 Saba ..... H01R 13/6272 439/352
6,561,834 B2 * 5/2003 Chen ..... H01R 13/6272 439/357
8,038,486 B1 * 10/2011 Nakamura ..... H01R 13/4362 439/752
2005/0082840 A1 4/2005 Ichida et al.
2006/0057881 A1 3/2006 Ichida et al.
2006/0079110 A1 4/2006 Ichida et al.
2012/0302085 A1 * 11/2012 Kyoyama ..... H01R 13/516 439/357

FOREIGN PATENT DOCUMENTS

JP 2005-166604 6/2005
JP 2011-243481 12/2011

* cited by examiner

*Primary Examiner* — Tho D Ta
(74) *Attorney, Agent, or Firm* — Gerald E. Hespos; Michael J. Porco; Matthew T. Hespos

(57) ABSTRACT

It is aimed to provide a connector capable of dispersing stress during unlocking and avoiding enlargement in a connected state. A connector includes a housing body and a lock arm for locking a mating housing in a connected state. The lock arm includes a leg rising from the housing body and an arm body facing the housing body and extending to intersect the leg. The leg is inclined in a connecting direction of the mating housing with distance from the housing body. The lock arm includes an entrance space, into which a tip of the mating housing enters, in a formation range of the leg in the connecting direction and between the leg and the arm body.

3 Claims, 5 Drawing Sheets

CONNECTOR WITH LOCK ARM HAVING A FORWARDLY OPEN ENTRANCE SPACE THAT RECEIVES TIP OF MATING CONNECTOR TO SHORTEN FRONT-REAR DIMENSION AFTER CONNECTION

BACKGROUND

Field of the Invention

The disclosure relates to a connector.

Related Art

Japanese Unexamined Patent Publication No. 2005-166604 (FIGS. 18 and 19) discloses a female housing including a lock arm and a male housing including a locked portion. The lock arm locks the locked portion to lock the housings in a connected state. A locking state of the lock arm and the locked portion is released by a releasing arm. The releasing arm includes two legs rising from a body of the female housing. The legs are deflectable and have bases that define fulcrums. The legs are inclined rearward in a curved manner from the upper surface of a housing body.

Japanese Unexamined Patent Publication No. 2011-243481 (FIGS. 1 and 2) also discloses a housing with a lock arm. The lock arm includes two legs spaced apart in a width direction and extending obliquely to an upper-rear side from a body part of the housing. Two arms extend forward from the upper ends of the legs and a lock body extends between the front ends of the arms.

The legs disclosed in both Japanese Unexamined Patent Publication No. 2005-166604 and Japanese Unexamined Patent Publication No. 2011-243481 incline rearward. Thus, when a pressing force is applied from above in unlocking the lock arm, stress can be dispersed in a length direction of the legs and the damage and breakage of the legs can be prevented.

In the case of Japanese Unexamined Patent Publication No. 2005-166604 and Japanese Unexamined Patent Publication No. 2011-243481, when the male and female housings are in a connected state, the tip of the male housing and the legs are arranged at a distance from each other in a front-rear direction and there is a concern for enlargement in the front-rear direction. Thus, if an installation space for the connector is narrow in the front-rear direction, there is a problem of limiting use.

Accordingly, it is aimed to provide a connector capable of dispersing stress during unlocking and avoiding enlargement in a connected state.

SUMMARY

This disclosure is directed to a connector with a housing body connectable to a mating housing, and a lock arm for locking the mating housing in a connected state. The lock arm includes a leg rising from the housing body and an arm facing the housing body and extending to intersect the leg. The lock arm is deflectable with the leg as a fulcrum. The leg is inclined in a connecting direction of the mating housing with distance from the housing body. The lock arm includes an entrance space into which a tip of the mating housing enters. The entrance space is in a formation range of the leg in the connecting direction and between the leg and the arm body.

According to this configuration, when the housing body is connected properly to the mating housing, the tip of the mating housing can enter the entrance space to be located at a position overlapping the leg in the connecting direction. Thus, the connector in the connected state is not enlarged in the connecting direction. Further, the leg is inclined in the connecting direction with distance from the housing body. Thus, stress acting on the lock arm is dispersed equally in a length direction of the leg when unlocking the lock arm. As a result, damage and breakage of the leg is prevented.

The mating housing may include a receptacle to receive the housing body. A tip of the receptacle includes a guiding portion that guides the housing body and enters the entrance space. The guiding portion is thinner than an adjacent region of the receptacle. Thus, the guiding portion easily enters the entrance space and can deal with the narrowing of the entrance space.

A detector may be provided and may be allowed to move from a standby position to a detection position with respect to the housing body when the housing body and the mating housing are connected properly. A second entrance space may be provided in the formation range of the leg in the connecting direction and between the leg and the housing body on a side opposite to the entrance space across the leg. A reinforcing portion of the detector may enter the second entrance space. The reinforcing portion of the detector can be at a position overlapping the leg in the connecting direction by entering the second entrance space to avoid enlargement in the connecting direction more satisfactorily. Further, the inclination of the leg toward the second entrance space can be prevented and a locking state by the lock arm can be maintained reliably by the entrance of the reinforcing portion of the detector into the second entrance space.

According to this disclosure, it is possible to disperse stress during unlocking and avoid enlargement in a connected state.

DETAILED DESCRIPTION

A specific example of the connector of the present disclosure is described below with reference to the drawings. Note that the invention is not limited to these illustrations and is intended to be represented by claims and includes all changes in the scope of claims and in the meaning and scope of equivalents.

A connector includes a housing 10 and a detector 60. The housing 10 is connectable to a mating housing 90. In the following description, surfaces facing each other when the connection of the housings 10, 90 is started are referred to as front ends concerning a front-rear direction. A vertical direction is based on all figures except FIG. 5.

<Housing 10>

Figure 1:
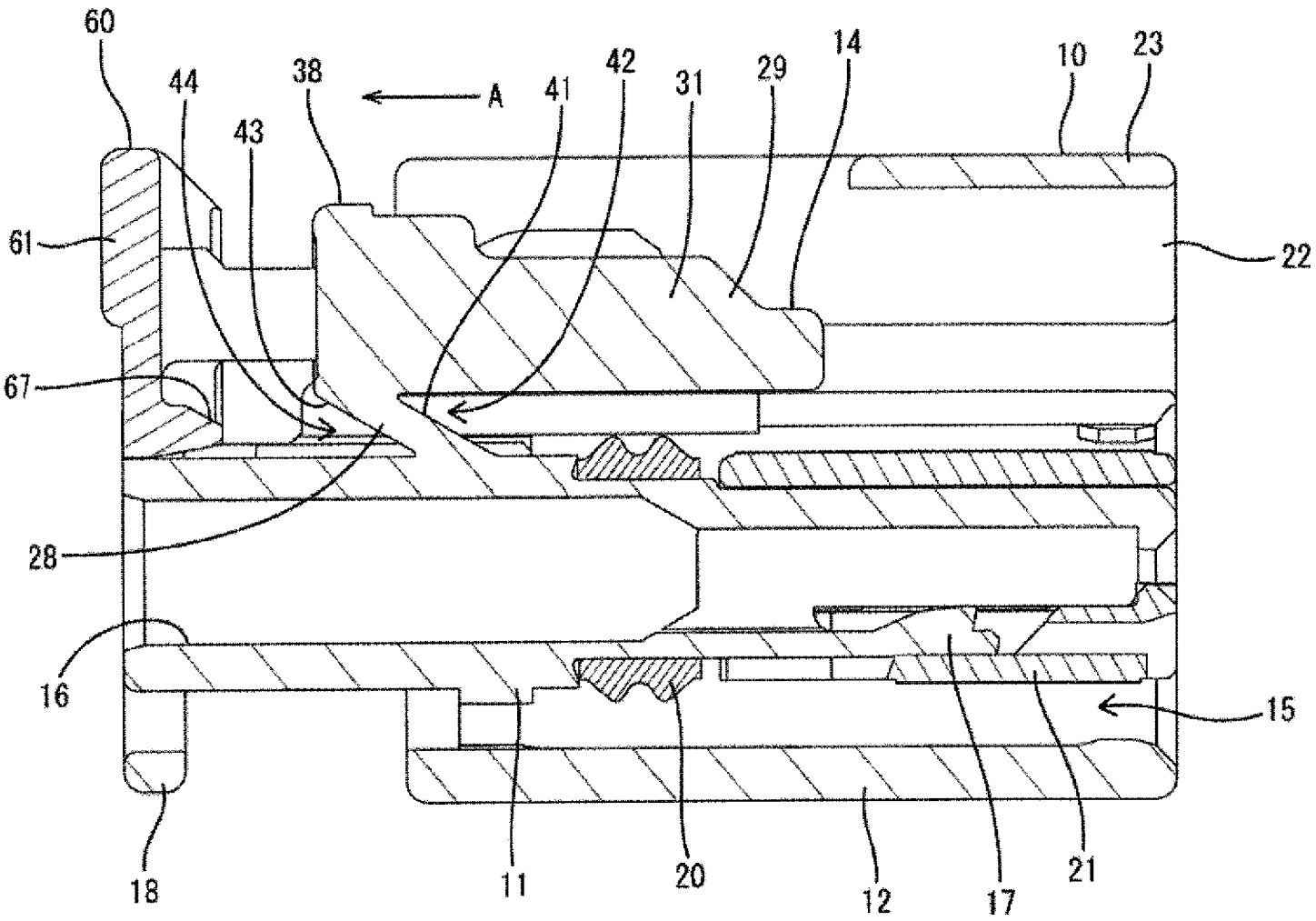
FIG. 1 is a section showing a state where a detecting member is disposed at a standby position with respect to a housing in a connector according to one embodiment.

The housing 10 is made of synthetic resin and includes, as shown in FIG. 1, a housing body 11, a fitting tube 12 surrounding the outer periphery of the housing body 11, a coupling 13 radially extending and linking the housing body 11 and the fitting tube 12, and a lock arm 14 provided above the housing body 11. A space between the housing body 11 and the fitting tube 12 and forward of the coupling 13 serves as a fitting space 15 into which a later-described receptacle 91 (see FIGS. 2 and 3) of the mating housing 90 is fit.

Figure 2:
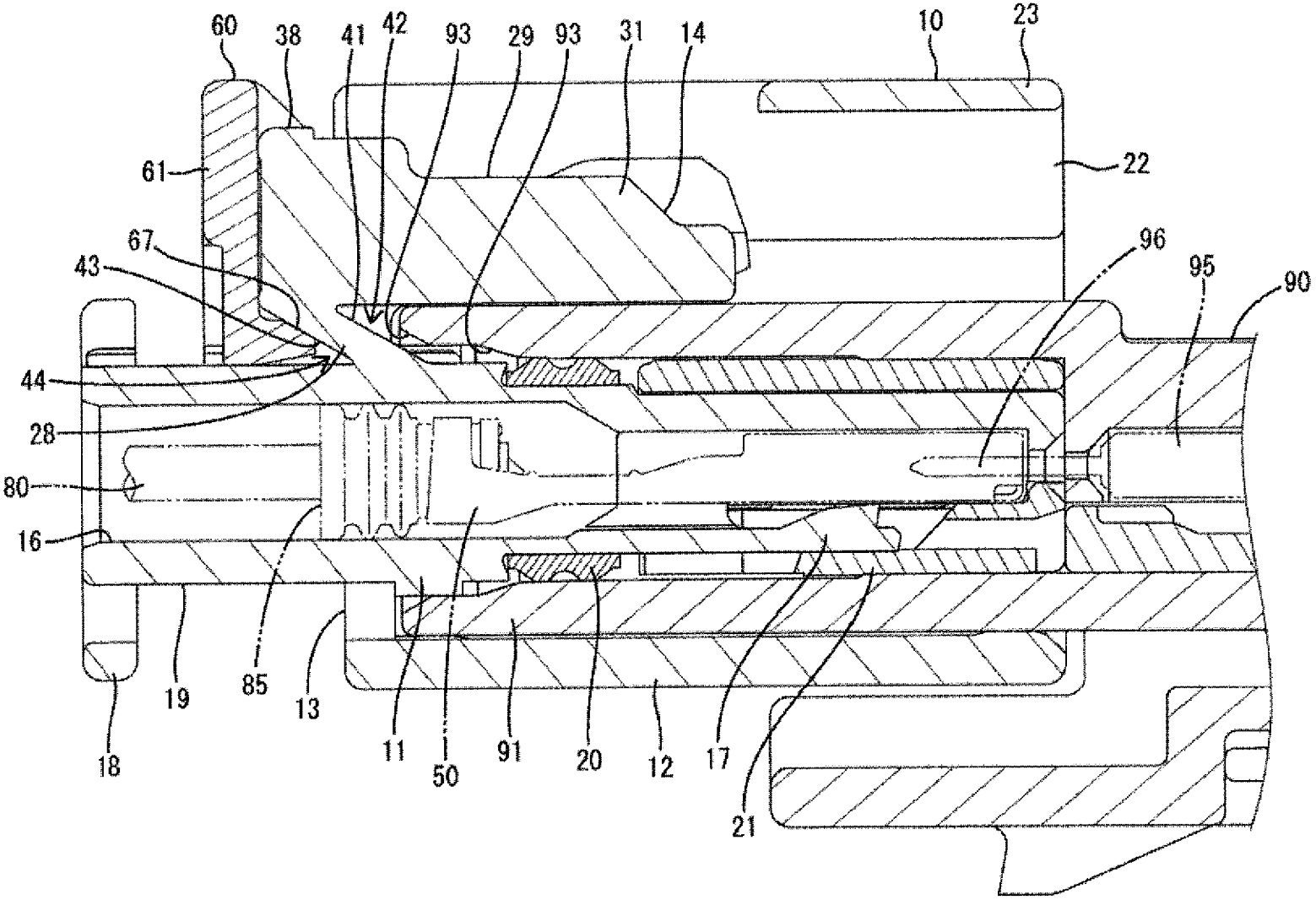
FIG. 2 is a section showing a state where the housing is connected to a mating housing and the detector has reached a detection position.
Figure 4:
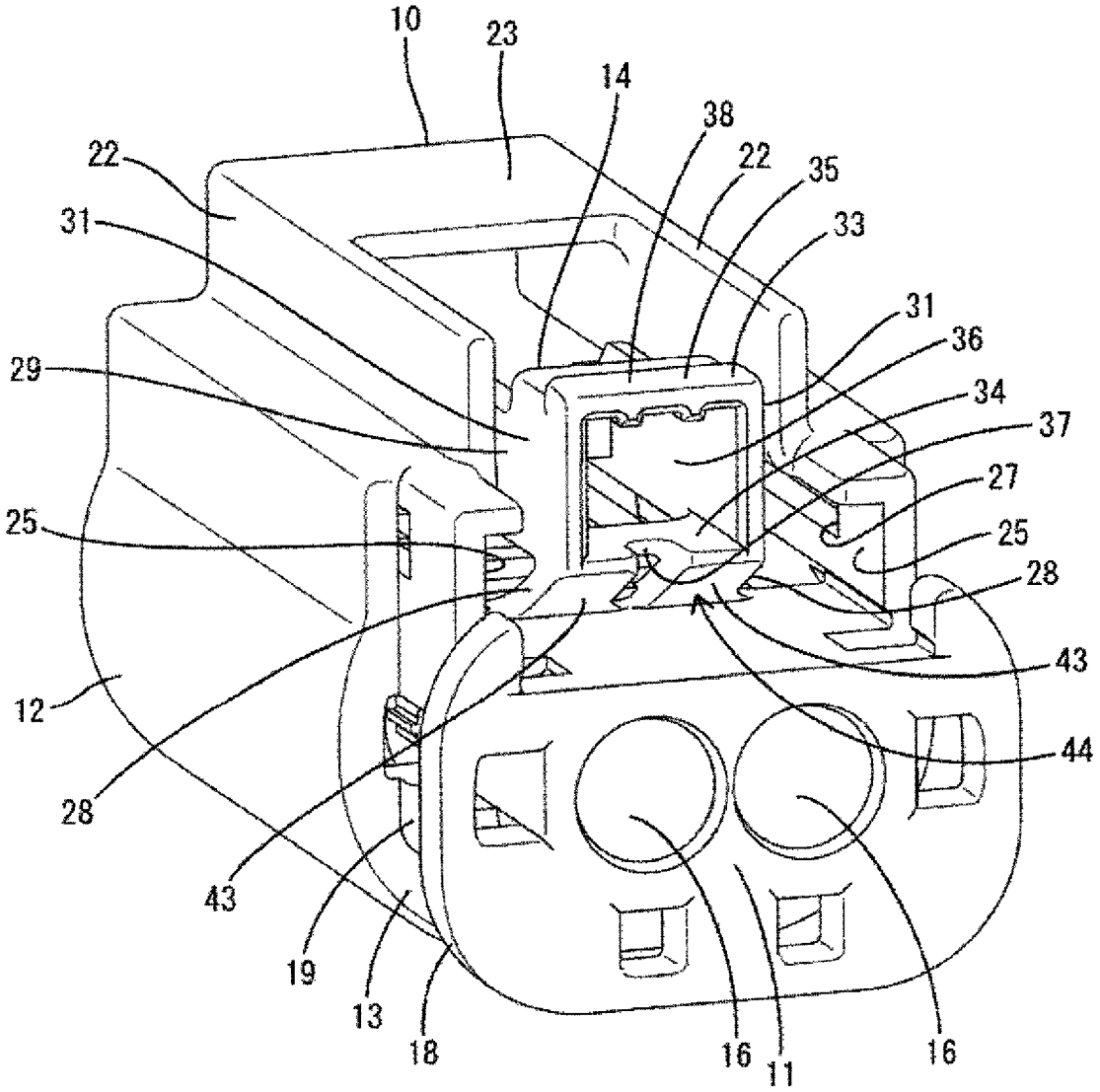
FIG. 4 is a perspective view of the housing viewed from behind.

Cavities 16 penetrate the housing body 11 in the front-rear direction. As shown in FIG. 4, the cavities 16 are provided laterally side by side in the housing body 11. As shown in FIG. 2, deflectable locking lances 17 are provided at the lower surfaces of the cavities 16 of the housing body 11. Terminal fittings 50 are inserted into the cavities 16 from behind.

As shown in FIG. 2, each terminal fitting 50 is locked by one of the locking lances 17 and is retained in the cavity 16 of the housing body 11. Each terminal fitting 50 is made of conductive metal and is connected mechanically and electrically to an end part of a wire 80 with a rubber plug 85 fit on the outer periphery of the wire 80. The plug 85 is made of rubber, such as silicon rubber, and is inserted into the cavity 16 in a liquid-tight manner.

As shown in FIG. 4, the housing body 11 includes a radially protruding flange 18 on a rear end part. A mounting groove 19 is provided circumferentially between the flange 18 and the coupling 13 on the outer peripheral surface of the housing body 11, and an unillustrated cover can be mounted therein.

An annular sealing member 20 is fit on the outer peripheral surface of the housing body 11. The sealing member 20 is made of rubber, such as silicon rubber, and is in contact with a step in front of the coupling 13. As shown in FIG. 2, the sealing member 20 is compressed radially between the receptacle 91 and the housing body 11 when the housings 10, 90 are connected. The housings 10, 90 are sealed in a liquid-tight manner via the sealing member 20.

As shown in FIGS. 1 and 2, a front retainer 21 is mounted into the housing body 11 from the front. The front retainer 21 is made of synthetic resin and covers the front surface of the housing body 11. The front retainer restricts forward escape of the sealing member 20 and prevents deflection of the locking lances 17. The front retainer 21 secondarily retains the terminal fittings 50 by restricting the deflection of the locking lances 17.

As shown in FIG. 4, two side walls 22 are arranged on an upper part of the fitting tube 12. The side walls 22 are arranged along the vertical direction on both left and right sides of the lock arm 14, and an upper wall 23 extends between upper ends of the side walls 22 above the lock arm 14.

The side walls 22 are formed from the front end of the housing 10 to positions near a rear end. As shown in FIG. 4, rearwardly open grooves 25 extend in the front-rear direction on inner surfaces of the side walls 22, and retaining portions 27 (only one is shown in FIG. 4) are formed on the inner surfaces of the grooves 25.

The upper wall 23 is connected to front parts of upper ends of the side walls 22. The lock arm 14 is behind the upper wall 23 and can be confirmed visually in a plan view.

The lock arm 14 includes left and right legs 28 rising from the upper surface of the housing body 11, as shown in FIG. 4. An arm body 29 intersects the legs 28 and extends forward from the upper ends of the legs 28, as shown in FIG. 1.

Rising end parts of the legs 28 are connected to a rear part of the arm body 29, and base parts of the legs 28 are connected to the upper surface of the housing body 11. The legs 28 are in the form of plates extending along a lateral direction and linearly incline rearward from the base parts to the rising end parts. In other words, both legs 28 are inclined to be displaced (retreat) in a connecting direction (direction of an arrow A of FIG. 1) of the mating housing 90 from the base parts to the rising end parts.

As shown in FIG. 1, the front surfaces of both legs 28 form inclined surfaces 41 facing the fitting 15 from behind and facing the arm body 29 from below. The lock arm 14 includes an entrance space 42, into which a tip part of the later-described receptacle 91 of the mating housing 90 enters, between the inclined surfaces 41 of the legs 28 and a region of the lower surface of the arm body 29 vertically facing the inclined surfaces 41 in a formation range in the front-rear direction of both legs 28 (region from the front ends of the base parts of the legs 28 to the rear ends of the rising end parts). The entrance space 42 has a triangular shape with a back end on the side of the arm body 29 as a vertex and is open forward in a side cross-sectional view.

The rear surfaces of both legs 28 form second inclined surfaces 43 facing the housing body 11 from above and defining a space that can receive the detector 60 from the front. Angles of inclination of the second inclined surfaces 43 and the inclined surfaces 41 with respect to the vertical direction are equal. Both legs 28 have a constant front-rear thickness in a length direction. A second entrance space 44 is formed between the second inclined surfaces 43 of the legs 28 and a region of the upper surface of the housing body 11 extending along the formation range of the legs 28 in the front-rear direction. Later-described reinforcing portions 67 of the detector 60 can enter the second entrance space 44. The second entrance space 44 has a triangular shape with a back end on the side of the housing body 11 as a vertex and is open rearward in a side cross-sectional view.

Figure 3:
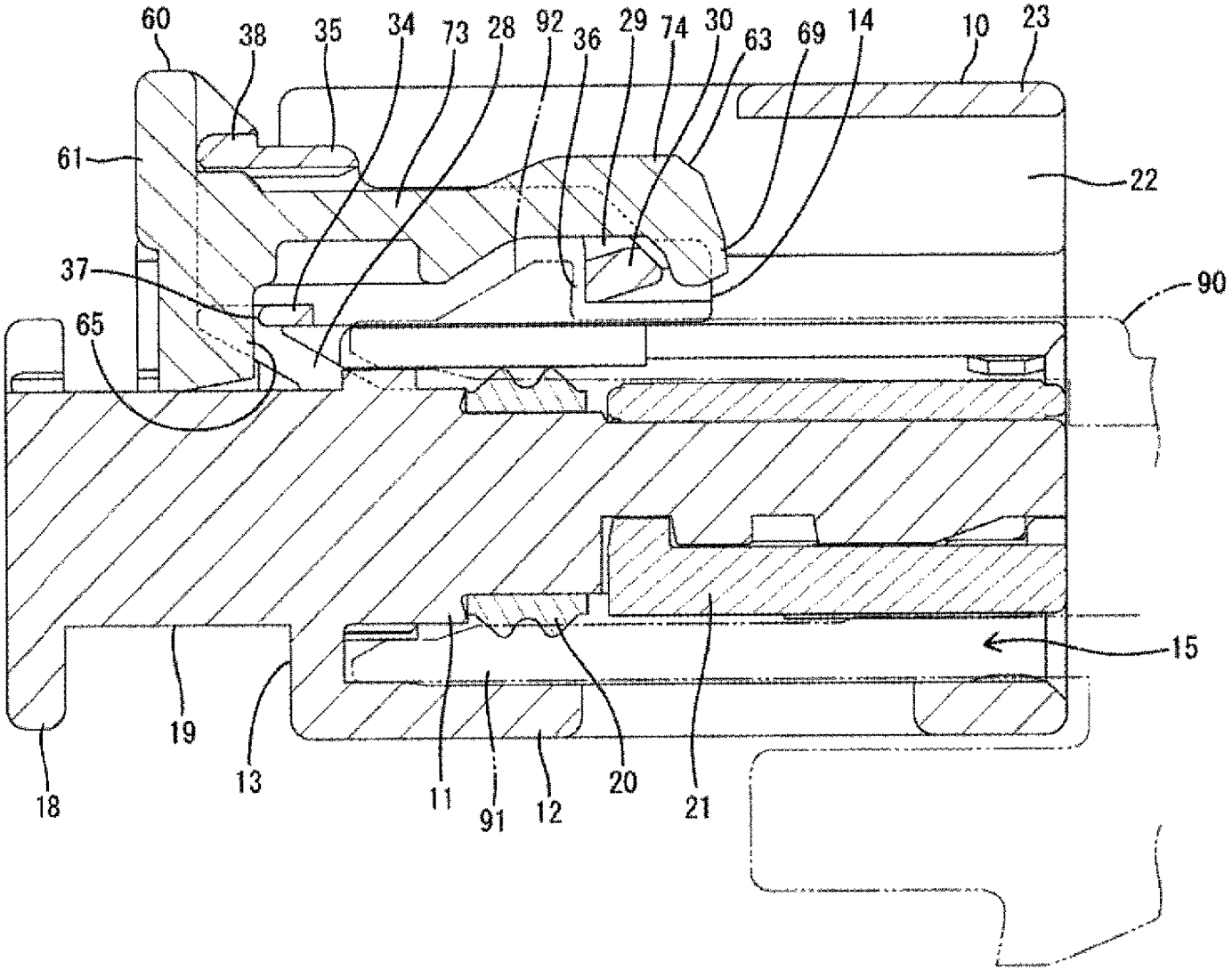
FIG. 3 is a section cut at a position different from that of FIG. 2 showing the state where the housing is connected to the mating housing and the detector is at the detection position.

The arm body 29 includes a locking portion 30 extending along the lateral direction on a front part, as shown in FIG. 3, and includes two links 31 extending in the front-rear direction on both left and right sides of the locking portion 30, as shown in FIG. 4. As shown in FIG. 1, the lower surfaces of both links 31 are flat along the front-rear direction and define the upper surface of the entrance space 42 in rear end parts.

The links 31 form plates extending along the front-rear and vertical directions with front end parts thereof connected to both left and right ends of the locking portion 30, and rear end parts thereof are connected to the both legs 28, as shown in FIG. 4.

As shown in FIG. 4, the arm body 29 includes a rectangular frame 33 in a rear end part. The frame 33 includes a stopper 34 laterally extending between the upper ends of the legs 28 and a releasing portion 35 arranged to face the stopper 34 above the stopper 34. The stopper 34 and the releasing portion 35 are in the form of plates extending along the front-rear and lateral directions. Left and right ends of the stopper 34 are connected to the lower ends of rear end parts of the links 31. Both left and right ends of the releasing portion 35 are connected to the upper ends of the rear end parts of the links 31. The releasing portion 35 is arranged to be higher than other areas in the arm body 29.

As shown in FIG. 3, the arm body 29 includes an insertion hole 36 behind the locking portion 30 and between the links 31. The insertion hole 36 penetrates through the frame 33 in the front-rear direction and is open up and down between the locking portion 30 and the frame 33. A later-described locking piece 63 of the detector 60 is inserted into the insertion hole 36 from behind.

As shown in FIG. 4, the rear end of the stopper 34 includes a recess 37 located at a position between the legs 28 in the lateral direction and is cut into a U shape. Left and right edges of the recess 37 are continuous with the facing inner surfaces of the legs 28 without step.

The upper surface of the releasing portion 35 is a flat surface exposed upward and includes a rib-like protrusion 38 extending in the lateral direction in a rear end part. As shown in FIG. 1, the protrusion 38 is at a position overlapping the rising end parts of the legs 28 in the front-rear direction and behind the base parts of the legs 28. If the upper surface of the releasing portion 35 is pressed, the arm body 29 is inclined to displace the locking portion 30 up with the both legs 28 as fulcrums.

<Detector 60>

Figure 5:
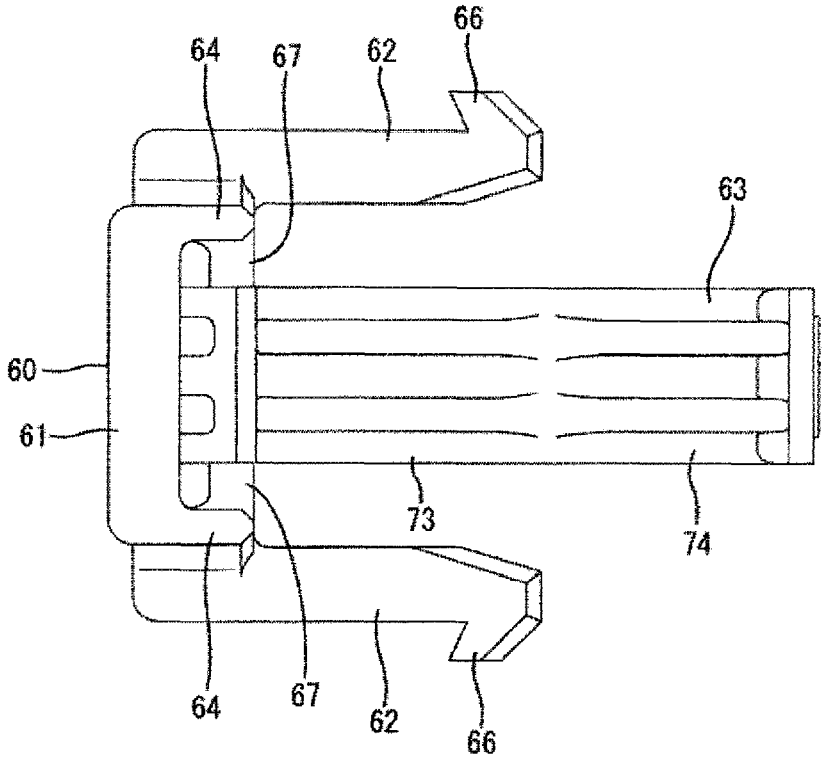
FIG. 5 is a plan view of the detector.
Figure 6:
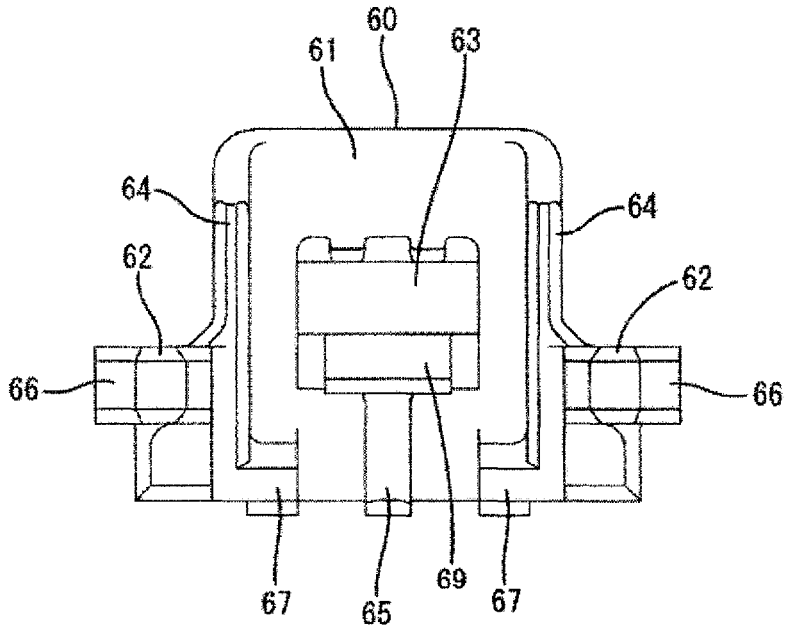
FIG. 6 is a front view of the detecting member.

The detector 60 is made of synthetic resin and includes, as shown in FIGS. 5 and 6, a wall 61 extending along the vertical and lateral directions. Two retaining pieces 62 project forward from both left and right ends of a lower part of the wall 61, and the locking piece 63 projects forward from a vertically and laterally intermediate part of the wall 61. The detector 60 is movable with respect to the housing 10 in the front-rear direction to a standby position where the wall 61 is behind and at a distance from the arm body 29, as shown in FIG. 1, and a detection position where the wall 61 can contact the rear end of the arm body 29, as shown in FIGS. 2 and 3.

The wall 61 is vertical and is dimensioned to cover a rear region between the side walls 22. The wall 61 includes two rib-like projecting pieces 64 extending vertically on both left and right sides of the front surface. The projecting pieces 64 are formed over the entire height of the wall 61. The outer surfaces of lower parts of the projecting pieces 64 are connected to the retaining pieces 62.

As shown in FIG. 6, the lower part of the wall 61 includes a rib-like fitting projecting piece 65 extending in the vertical direction in a laterally intermediate part of the front surface. Further, the lower part of the wall 61 includes two claw-like reinforcing portions 67 projecting forward on both left and right sides of the front surface. The lower surfaces of the reinforcing portions 67 are continuous with the lower surface of the wall 61. The outer surfaces of the reinforcing portions 67 are connected to the projecting pieces 64. The upper surfaces of the reinforcing portions 67 are inclined down toward the front. When the detector 60 is at the detection position, the reinforcing portions 67 enter the second entrance space 44 of the housing 10, as shown in FIG. 2. The upper surfaces of the reinforcing portions 67 are arranged along the second inclined surfaces 43. Angles of inclination of the upper surfaces of the reinforcing portions 67 and the second inclined surfaces 43 with respect to the vertical direction are equal.

The retaining pieces 62 are deflectable in and out (left and right) with base parts connected to both left and right end parts of the wall 61 as fulcrums. The retaining pieces 62 are fit into the grooves 25 of the side walls 22. The retaining pieces 62 include claw-like retaining projections 66 projecting out on front end parts. The retaining projections 66 of the retaining pieces 62 are locked to face the retaining portions 27 at the standby position.

The locking piece 63 is vertically deflectable with a base part connected to a laterally intermediate part of the wall 61 as a fulcrum. As shown in FIG. 5, the front end of the locking piece 63 is arranged in front of the front ends of the retaining pieces 62.

As shown in FIG. 3, the locking piece 63 extends straight forward from the wall 61, and the rear part 73 of the locking piece 63 is connected to the upper end of the fitting projecting piece 65.

As shown in FIG. 3, a front part 74 of the locking piece 63 has a part arranged higher than the rear part 73. The front part 74 of the locking piece 63 includes a claw-like locking projection 69 projecting down from a tip, and a part rearward of the projection 69 is curved upward in a side view.

<Mating Housing 90>

The mating housing 90 is made of synthetic resin and is fixed to a device of an unillustrated vehicle. As shown in FIG. 2, the mating housing 90 includes the tubular receptacle 91 projecting forward. Tabs 96 of mating terminal fittings 95 project into the receptacle 91. As shown in FIG. 3, a lock protrusion 92 projects on the upper surface of the receptacle 91. As shown in FIG. 2, the receptacle 91 includes guiding portions 93 formed by obliquely cutting an inner surface on an opening end. The guiding portions 93 are arranged in a divided manner in front and rear regions across a straight region along the front-rear direction on the inner surface on the opening end of the receptacle 91. A part of the receptacle 91 on the opening end enters the entrance space 42 of the lock arm 14. Angles of inclination of the guiding portions 93 and the inclined surfaces 41 with respect to the vertical direction are equal.

<Connector Connecting and Separating Operations>

Prior to the connection of the connector, the detector 60 is assembled with the housing 10 from behind. When the detector 60 reaches the standby position, the retaining projections 66 of the retaining pieces 62 are arranged to face and lock to the retaining portions 27, and the locking projection 69 of the locking piece 63 is arranged to face and lock to the locking portion 30 of the arm body 29 from behind. In this way, the detector 60 is held at the standby position with respect to the housing 10 with a movement in the front-rear direction restricted. The locking piece 63 is inserted into the insertion hole 36 of the arm body 29 through the frame 33.

Subsequently, the receptacle 91 of the mating housing 90 is inserted into the fitting space 15 of the housing 10. In the process of connecting the housings 10, 90, the lock protrusion 92 interferes with the locking portion 30 and the lock arm 14 is deflected and deformed with the legs 28 as fulcrums. The arm body 29 is inclined obliquely to an upper-front side from the rear end connected to the legs 28 to a front end. The lock protrusion 92 slides on the lower surface of the locking portion 30. When the housings 10, 90 are connected properly, the lock arm 14 resiliently returns, the arm body 29 is arranged along the front-rear direction and the lock protrusion 92 is inserted into the insertion hole 36 of the arm body 29 from below. The lock protrusion 92 is arranged to face and lock to the locking portion 30 from the side of the insertion hole 36, where the housings 10, 90 are held in a connected state. The terminal fittings 50 are electrically to the tabs 96 of the mating terminal fittings 95.

When the housings 10, 90 are connected properly, the part of the receptacle 91 on the opening end enters the entrance space 42 of the lock arm 14 and the guiding portions 93 are arranged to face in parallel to the inclined surfaces 41 (see FIG. 2). The upper surface of the receptacle 91 is arranged along the lower surfaces of the links 31 of the arm body 29. The inner surface of the receptacle 91 is held resiliently in close contact with the sealing member 20 behind the guiding portions 93. In this way, liquid-tight sealing is provided between the receptacle 91 and the housing body 11.

Further, as the lock protrusion 92 is inserted into the insertion hole 36, the locking projection 69 is pressed by the lock protrusion 92 to be displaced upward. In this way, the locking of the locking projection 69 and the locking portion 30 is released and the detector 60 becomes movable forward toward the detection position.

Subsequently, the upper part of the wall 61 is held with fingers and the detector 60 is pushed forward. In the process of moving the detector 60, the wall 61 slides in contact with the upper surface of the housing body 11 and the retaining pieces 62 slide in contact with the inner surfaces of the grooves 25 of the side walls 22. Further, in the process of moving the detector 60, the rear part 73 of the locking piece 63 is displaced in the frame 33, the front part 74 of the locking piece 63 is deflected and deformed and the locking projection 69 slides in contact with the upper surface of the locking portion 30. When the detector 60 reaches the detection position, the locking piece 63 resiliently returns and, as shown in FIG. 3, the locking projection 69 faces and locks to the front surface of the locking portion 30.

At the detection position, the lower part of the wall 61 is in contact with the stopper 34, the fitting projecting piece 65 is inserted between the legs 28 and in the recess 37 and the projecting pieces 64 are arranged to face the outer surfaces of the links 31 to embrace the frame 33. A movement of the detector 60 farther forward than the detection position is restricted by the contact of the lower part of the wall 61 with the stopper 34. Further, at the detection position, the wall 61 is arranged along the rear end of the arm body 29.

As shown in FIG. 2, both reinforcing portions 67 of the detector 60 are inserted in the second entrance space 44 of the housing 10 and the upper surfaces thereof are arranged along the second inclined surfaces 43 of the legs 28 at the detection position.

The wall 61 of the detector 60 is arranged along the rear end of the arm body 29 and the reinforcing portions 67 of the detector 60 are arranged along the second inclined surfaces 43 of the legs 28 to suppress a vertical loose movement of the rear part of the lock arm 14. Thus, when the detector 60 is at the detection position, the inclination of the arm body 29 with the legs 28 as fulcrums is restricted and the locking state of the lock arm 14 and the lock protrusion 92 is maintained reliably.

As described above, when the housings 10, 90 are in a properly connected state, the detector 60 is movable to the detection position. On the other hand, if the housings 10, 90 do not reach the properly connected state, the lock protrusion 92 is not inserted into the insertion hole 36 and the locking of the locking projection 69 and the locking portion 30 is maintained. Thus, even if a forward pushing force is applied to the detector 60, the detector 60 cannot be moved to the detection position. Thus, it can be detected that the housings 10, 90 are in the properly connected state if the detector 60 becomes movable to the detection position.

On the other hand, in separating the housings 10, 90 for maintenance or other reason, the upper part of the wall 61 is pulled strongly rearward. Then, the locking projection 69 rides over the locking portion 30 and the detector 60 is returned to the standby position while the locking piece 63 is deflected. The locking projection 69 rides on the lock protrusion 92 and the front part 74 of the locking piece 63 is deflected and deformed.

Subsequently, a pressing force is applied to the releasing portion 35 from above. Then, the lock arm 14 is deflected and deformed with the legs 28 as fulcrums, and the front end of the arm body 29 is displaced up. In this way, the locking projection 69 is disengaged from the locking portion 30. In that state, the housings 10, 90 are pulled in separating directions and pulled apart from each other.

On the other hand, even if a pressing force is applied to the detector 60 from above, the locking of the locking projection 69 and the locking portion 30 is not released since the lock arm 14 is not interlocked with the detector 60.

As described above, the legs 28 are inclined to retreat from the upper surface of the housing body 11 toward the upper side in the case of this embodiment. Thus, stress acting on the legs 28 can be dispersed equally in the length direction of the legs 28 when the upper surface of the releasing portion 35 is pressed in releasing the locking state of the lock arm 14 and the lock protrusion 92. As a result, damage and breakage of the legs 28 can be prevented.

Further, when the housings 10, 90 are in the properly connected state, the part of the receptacle 91 on the opening end enters the entrance space 42 of the lock arm 14 and the part of the receptacle on the opening end, and the legs 28 are arranged at the positions overlapping in the front-rear direction in the formation range of the legs 28. Thus, it is possible to avoid the enlargement of the entire connector in the connected state in the front-rear direction.

The part of the receptacle 91 on the opening end is thinner than an adjacent part by forming the guiding portions 93. Thus, the guiding portions 93 of the receptacle 91 enter the narrow entrance space 42 so that small-size connectors can be also dealt with.

Further, the second entrance space 44 that receives the reinforcing portions 67 of the detector 60 is formed in a space between the legs 28 and the housing body 11 on a side opposite to the entrance space 42 across the legs 28. When the detector 60 is at the detection position, the reinforcing portions 67 entering the second entrance space 44 and the legs 28 are at the positions overlapping in the front-rear direction in the formation range of the legs 28. Thus, the enlargement in the front-rear direction can be avoided more satisfactorily. In addition, since the inclination of the legs 28 toward the second entrance space 44 can be prevented by the entrance of the reinforcing portions 67 of the detector 60 into the second entrance space 44, the locking state of the lock arm 14 and the lock protrusion 92 can be reliably maintained.

It should be understood that the embodiment disclosed is illustrative in all aspects and not restrictive.

For example, although the two legs 28 are provided via the recess 37 in the above embodiment, a single leg may be provided as another embodiment.

Although the second entrance space 44 into which the reinforcing portions 67 of the detector 60 enter is provided between the leg 28 and the housing body 11 in the above embodiment, reinforcing portions of a detector may not enter between legs and a housing body as another embodiment. Further, application to connectors with no detector is possible.

Although the legs 28 rise straight from the housing body 11 in the above embodiment, legs may rise in a curved manner from a housing body as another embodiment.

LIST OF REFERENCE SIGNS

10 . . . housing
11 . . . housing body
12 . . . fitting tube
13 . . . coupling
14 . . . lock arm
15 . . . fitting space
16 . . . cavity

17 . . . locking lance
18 . . . flange
19 . . . mounting groove
20 . . . sealing member
21 . . . front retainer
22 . . . side wall
23 . . . upper wall
25 . . . groove
27 . . . retaining portion
28 . . . leg
29 . . . arm
30 . . . locking portion
31 . . . link
33 . . . frame
34 . . . stopper
35 . . . releasing portion
36 . . . insertion hole
37 . . . recess
38 . . . protrusion
41 . . . inclined surface
42 . . . entrance space
43 . . . second inclined surface
44 . . . second entrance space
50 . . . terminal fitting
60 . . . detector
61 . . . wall
62 . . . retaining piece
63 . . . locking piece
64 . . . projecting piece
65 . . . fitting projecting piece
66 . . . retaining projection
67 . . . reinforcing portion
69 . . . locking projection
73 . . . rear part (of locking piece)
74 . . . front part (of locking piece)
80 . . . wire
85 . . . rubber plug
90 . . . mating housing
91 . . . receptacle
92 . . . lock protrusion
93 . . . guiding portion
95 . . . mating terminal fitting
96 . . . tab

What is claimed is:

1. A connector assembly, comprising:

a mating housing with a receptacle having a tip part;

a housing body having a front end connectable into the receptacle of the mating housing; and a lock arm formed on the housing body for locking the housing body to the mating housing in a connected state, wherein:

the lock arm includes a leg rising obliquely rearwardly from the housing body and an arm body facing the housing body and extending forward from an end of the leg outward of the housing body, the lock arm being deflectable with the leg as a fulcrum, the leg is inclined in a connecting direction of the mating housing with distance from the housing body, and the lock arm includes an entrance space between the leg and the arm body, and the tip part of the mating housing being in the entrance space and between the leg and the arm body when the housing body is locked to the mating housing in the connected state.

2. The connector assembly of claim 1, wherein the receptacle includes a guiding portion on the tip part, the guiding portion guiding the housing body as the guiding portion enters the entrance space.

3. The connector assembly of claim 2, further comprising a detector allowed to move from a standby position to a detection position with respect to the housing body when the housing body and the mating housing are properly connected, wherein:

a second entrance space, into which a reinforcing portion of the detector enters, is provided in the formation range of the leg in the connecting direction and between the leg and the housing body on a side opposite to the entrance space across the leg.

* * * * *